US006729949B1

(12) United States Patent
McCoy

(10) Patent No.: US 6,729,949 B1
(45) Date of Patent: May 4, 2004

(54) SANDING AND CLEANING DEVICE FOR DRYWALL BULLNOSE CORNERBEADS

(75) Inventor: Charles D. McCoy, Sarasota, FL (US)

(73) Assignee: Pro-Line, Inc., Sarasota, FL (US)

( * ) Notice: Subject to any disclaimer, the term of this patent is extended or adjusted under 35 U.S.C. 154(b) by 0 days.

(21) Appl. No.: 10/165,485

(22) Filed: Jun. 7, 2002

(51) Int. Cl.[7] ..... C07C 2/02

(52) U.S. Cl. ..... 451/523; 451/524; 451/354; 451/344

(58) Field of Search ..... 451/523–525, 451/344, 354, 495, 44; 15/244.1, 244.2; 144/136.95; 407/29.13

(56) References Cited

U.S. PATENT DOCUMENTS

| | | | | |
|---|---|---|---|---|
| 1,927,574 A | | 9/1933 | Parks | |
| 2,402,069 A | | 6/1946 | Minnick | |
| 3,648,418 A | | 3/1972 | Churchich | |
| 3,733,663 A | * | 5/1973 | Brucker | 407/29.13 |
| 3,878,581 A | | 4/1975 | Perna | |
| 4,230,441 A | | 10/1980 | Heronema | |
| 4,330,964 A | | 5/1982 | Martinez | |
| 4,619,013 A | | 10/1986 | Yon | |
| 4,823,515 A | | 4/1989 | Blome | |
| 4,878,317 A | | 11/1989 | Ovens | |
| 4,907,955 A | | 3/1990 | Snipes | |
| 4,923,316 A | | 5/1990 | Fattal | |
| 4,946,360 A | | 8/1990 | Brown | |
| 5,069,610 A | | 12/1991 | Milburn | |
| 5,131,193 A | | 7/1992 | Demers | |
| 5,203,885 A | | 4/1993 | Pastre et al. | |
| 5,368,461 A | | 11/1994 | Murphy | |
| 5,392,484 A | | 2/1995 | Stoltzfus | |
| 5,544,384 A | | 8/1996 | Forselius | |
| 5,545,287 A | | 8/1996 | Carlson | |
| 5,638,570 A | | 6/1997 | Gruner | |
| 5,690,547 A | | 11/1997 | Holland, Jr. et al. | |
| 5,697,833 A | * | 12/1997 | Hislop | 451/344 |
| 5,759,090 A | | 6/1998 | Kawate et al. | |
| 5,895,316 A | | 4/1999 | Williams | |
| D411,672 S | | 6/1999 | McCoy | |
| 5,947,803 A | | 9/1999 | Gruner | |
| 5,954,571 A | | 9/1999 | Case | |
| 5,993,306 A | | 11/1999 | McCoy | |
| 6,116,999 A | * | 9/2000 | Montross | 451/524 |
| 6,439,983 B1 | * | 8/2002 | McCoy et al. | 451/354 |

FOREIGN PATENT DOCUMENTS

DE 3808138 A1 12/1989

* cited by examiner

*Primary Examiner*—George Nguyen
(74) *Attorney, Agent, or Firm*—Charles J. Prescott

(57) ABSTRACT

A device for abrading and finishing excess cured filler material from a bullnose cornerbead which forms an outside corner joint between immediately adjacent sheets of drywall. The device includes an elongated rigid body having a generally concave-shaped central longitudinal surface which receives a highly compressible thick foam-backed abrasive member which is preferably substantially coextensive with, and arcuately compressibly formable to match, the radiused bullnose joint contour. Two sets of spaced guide rollers extend longitudinally of the device adjacent each side margin of the longitudinal surface which, in cooperation with the compressible abrasive member, is matingly engageable against the bullnose corner to substantially match the outside corner angle between the adjacent drywall sheets when the device is pressed firmly against the bullnose corner.

8 Claims, 4 Drawing Sheets

SANDING AND CLEANING DEVICE FOR DRYWALL BULLNOSE CORNERBEADS

BACKGROUND OF THE INVENTION

1. Scope of Invention

This invention relates generally to devices for sanding and finishing drywall installations, and more particularly to a device for cleaning and finishing outside bullnose joints between adjacent sheets of drywall.

2. Prior Art

There are a number of prior art devices used for finishing drywall installation corners and surfaces. Some of these devices known to applicants are directed to the application of cementious drywall filler compound; the majority of these devices, however, are directed to the sanding, scraping or finishing of the cured drywall compound prior to painting or wallpapering the finished drywall surfaces.

The following U.S. patents are known to applicant which generally fit into this category of prior art devices:

| | |
|---|---|
| U.S. Pat. No. 5,544,384 | Forselius, et al. |
| U.S. Pat. No. 3,878,581 | Perna |
| U.S. Pat. No. 5,545,287 | Carlson |
| U.S. Pat. No. 4,907,955 | Snipes |
| U.S. Pat. No. 4,946,360 | Brown |
| U.S. Pat. No. 5,069,610 | Milburn |
| U.S. Pat. No. 4,619,013 | Yon |
| U.S. Pat. No. 4,230,441 | Heronema |
| U.S. Pat. No. 5,368,461 | Murphy |

All of these above prior art devices are either adapted to fill or finish flat drywall surfaces or inside or outside drywall joint areas which have sharp or crisp inside or outside corners, respectively.

A recently introduced feature for drywall outside corner joints is typically referred to as a "bullnose" cornerbead or joint. These outside radiused cornerbeads are formed of elongated metal strips which define an arcuate or radiused quarter circle sector or other similar sector cylindrical surface and are attached to the adjacent aligned edges of drywall panels.

The invention disclosed in U.S. Pat. No. 5,638,570 invented by Gruner teaches a drywall bullnose cleaner tool which scrapes excess filler compound from the radiused surfaces of an outside bullnose cornerbead of such a drywall installation. However, scraping action may not be best suited for optimal smooth finishing of the bullnose cornerbead. Another device for the scraping, cleaning and finishing of bullnose cornerbeads is disclosed by Stolzfus in U.S. Pat. No. 5,392,484. Again, the scraping of the cylindrical bullnose surface is not fully effective in producing a smooth, high quality finished surface ready for painting.

I was recently co-inventor of two U.S. patent, U.S. Pat. No. 5,993,306 and U.S. Des. Pat. No. 411,672. These devices generally teach a cleaning and finishing device for bullnose cornerbeads or joints which more gently and uniformly abrades away excess cured or hardened drywall filler compound without concern for overly abrading or grooving the drywall filler compound immediately adjacent the side margins of the metal bullnose cornerbead. Further, by including a somewhat resilient or compliant abrasive fibrous pad which accomplishes the cleaning and finishing action, any non-uniformity of the bullnose joint is easily accommodated.

The following additional prior art references are known to applicant as follows:

| | |
|---|---|
| U.S. Pat. No. 1,927,574 | Parks |
| U.S. Pat. No. 2,402,069 | Minnick, et al. |
| U.S. Pat. No. 5,690,547 | Holland, Jr., et al. |
| U.S. Pat. No. 4,923,316 | Fattal |
| DE 3808138A1 | Lazar |
| U.S. Pat. No. 5,954,571 | Case |
| U.S. Pat. No. 5,947,803 | Gruner |
| U.S. Pat. No. 5,895,316 | Williams |

The later three of these references are also directed to the sanding of rounded bullnose cornerbeads as is intended for invention. However, all have structural features and limitations which render them generally ineffective and even damaging to the filler plaster immediately adjacent to the hard typically metallic surface of the bullnose cornerbead.

Additionally, as disclosed in my prior '306 patent, the preferred abrasive medium was in the form of an open non-woven fibrous abrasive material such as that known as SCOTCH-BRITE by the 3M Company. Although this abrasive medium has offered a substantial improvement over conventional sanding paper against a hard radius or arcuate support surface, nonetheless the compressibility of the SCOTCH-BRITE material has not been ideal for the intended objective of removing all excess filler material from the bullnose corner without abrading the adjacent filler material.

Another prior patent-pending invention provides still further improvement and sanding accuracy in cleaning excess material from bullnose cornerbeads while avoiding the excess abrasion and grooving of the drywall filler compound immediately adjacent the margins of the bullnose cornerbead. However, the present invention replaces the spaced, parallel guide runners with two sets of two aligned guide rollers to still further reduce friction drag and gouging of the plaster filler.

BRIEF SUMMARY OF THE INVENTION

This invention is directed to a device for abrading and finishing excess cured filler material from a bullnose cornerbead which forms an outside corner joint between immediately adjacent sheets of drywall. The device includes an elongated rigid body having a generally concave-shaped central longitudinal surface which receives a highly compressible thick foam-backed adhesive member which is preferably substantially coextensive with, and arcuately compressibly formable to match the radiused bullnose joint contour. Two sets of two spaced guide rollers are spaced longitudinally of the device adjacent each side margin of the central longitudinal surface which, in cooperation with the compressible abrasive member is matingly engageable against the bullnose corner to substantially match the outside corner angle between the adjacent drywall sheets when the device is pressed firmly against the bullnose corner.

It is therefore an object of this invention to provide an improved sanding and cleaning device for removing and finishing bullnose cornerbead joints of drywall installations.

It is another object of this invention to provide a device for sanding and cleaning excess drywall filler or fairing compound from metal strips which form radiused bullnose joints between adjacent drywall panels.

It is still another object of this invention to provide a device for sanding and cleaning bullnose joints of drywall installations which readily accommodate any irregularity in the metallic strip forming these bullnose joints.

It is a further object of this invention to provide a device for sanding and cleaning excess drywall filler compounds from bullnose corner joints which include a replaceable elongated highly compressible abrasive pad or member.

In accordance with these and other objects which will become apparent hereinafter, the instant invention will now be described with reference to the accompanying drawings.

DETAILED DESCRIPTION OF THE INVENTION

Figure 1:
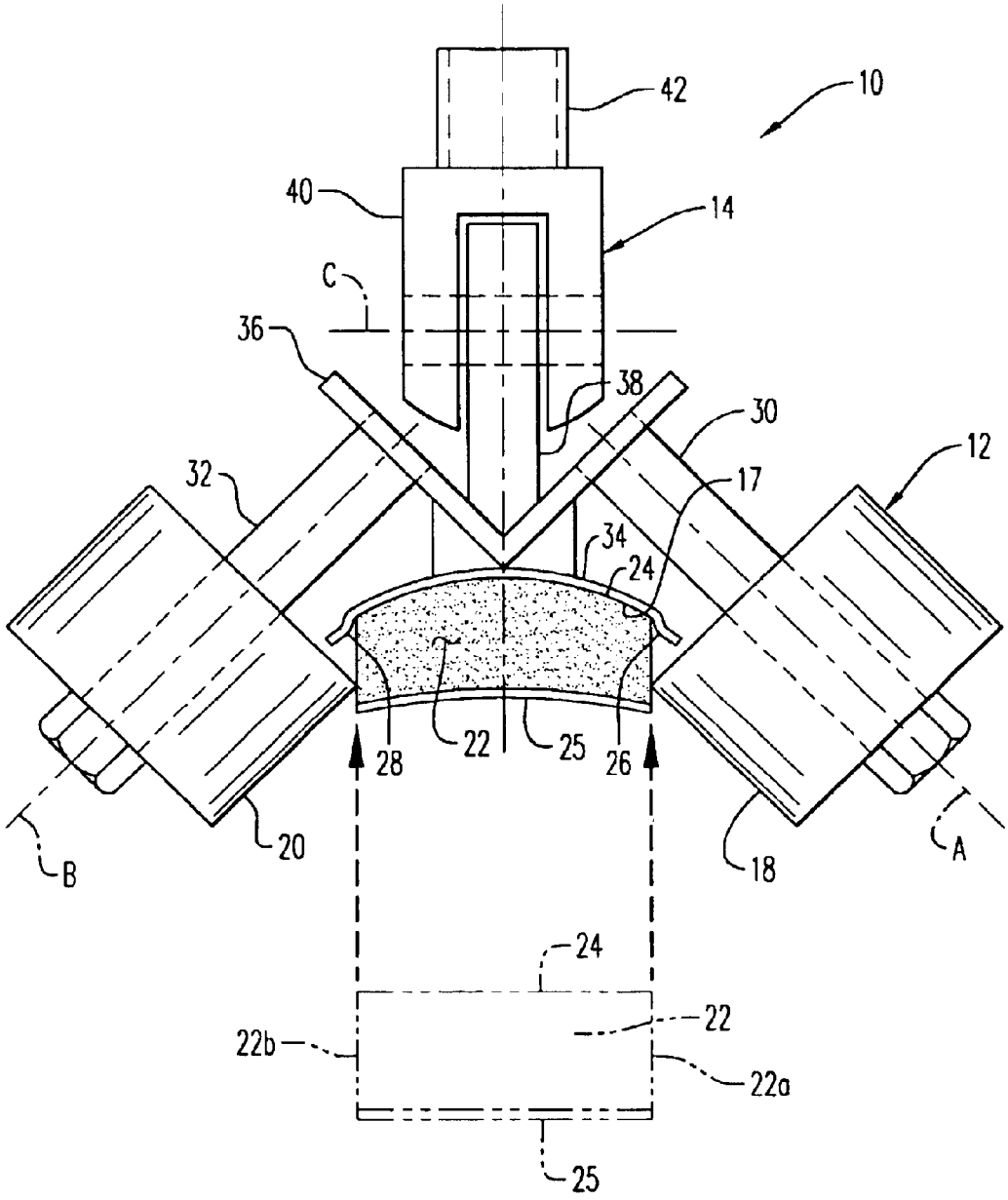
FIG. 1 is an enlarged end elevation view of the invention showing the replaceable abrasive member attached thereto.
Figure 2:
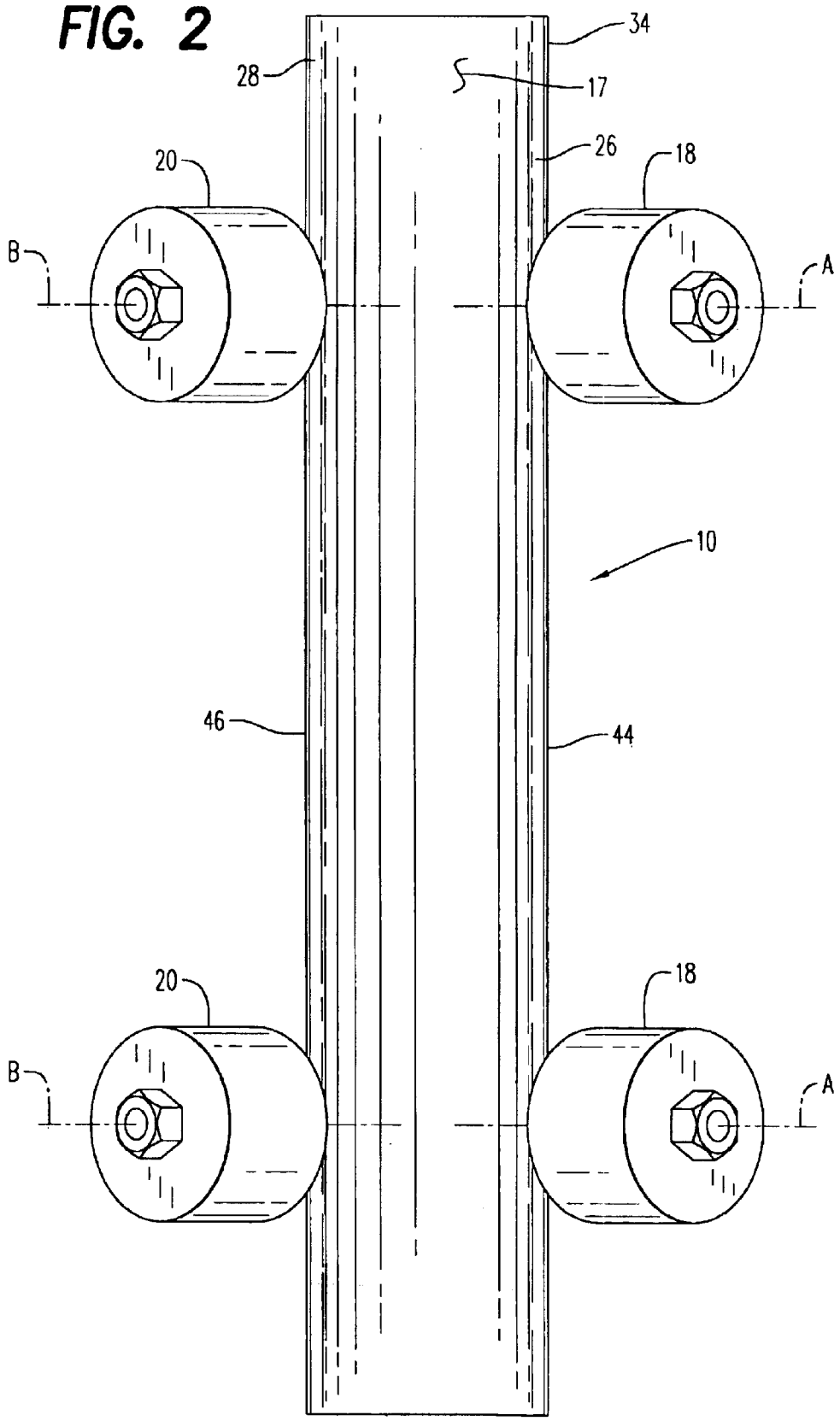
FIG. 2 is a bottom plan view of FIG. 1.
Figure 3:
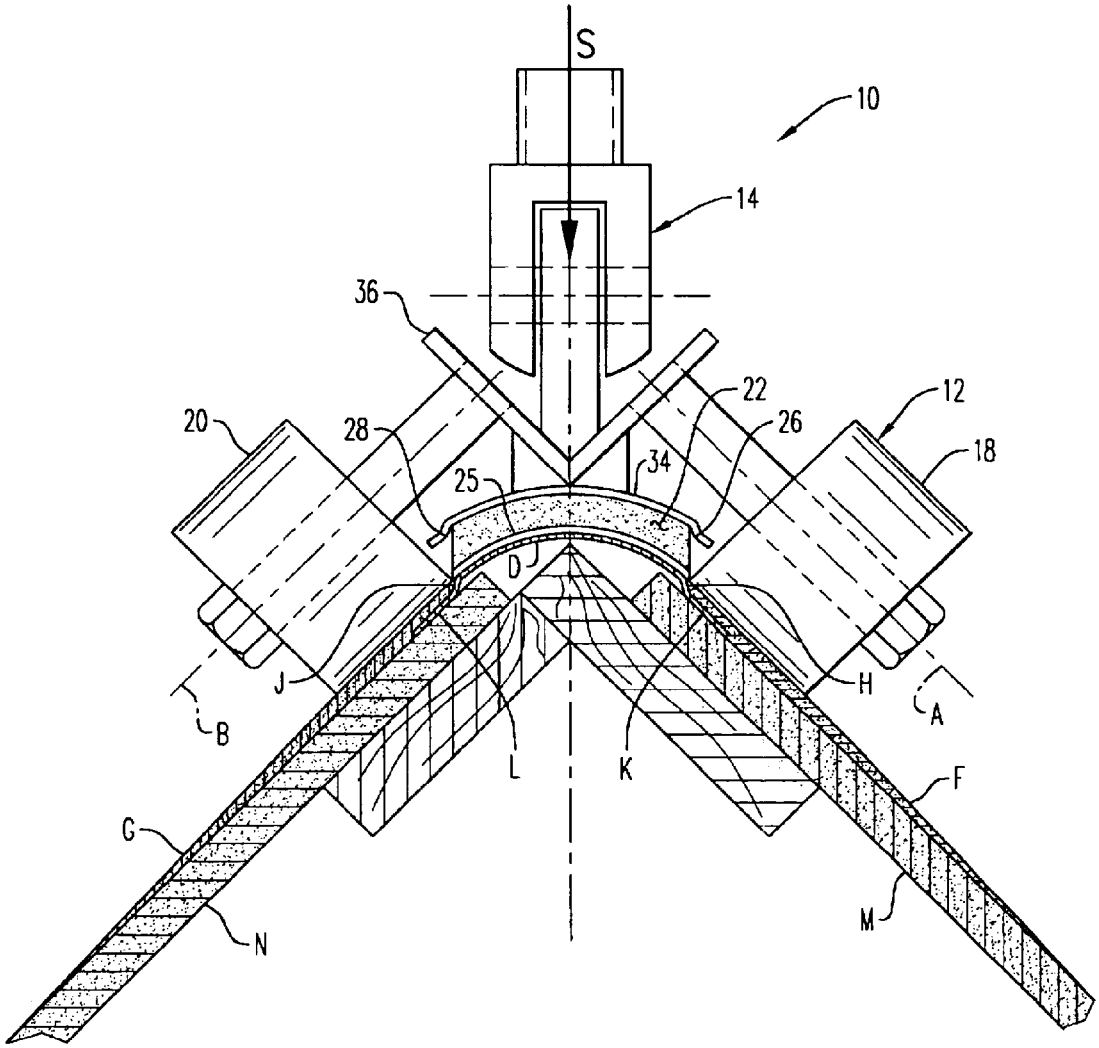
FIG. 3 is a view similar to FIG. 1 showing the present invention in functional engagement with a bullnose corner joint and adjacent wall panels.

Referring now to the drawings and firstly to FIGS. 1 to 3, one embodiment of the invention is shown generally at numeral 10. This sanding and abrading device 10 includes an elongated rigid body 12 having a handle 14 attached to the back surface thereof. A connection member 42 is connectable to an elongated sanding pole (not shown) and is pivotally connectable about axis C with respect to an elongated channel frame 36 of the elongated body 12.

An inner facing longitudinal surface 17 of an elongated arcuate support member 34 of body 12 is generally concaved and cylindrical in nature. Two sets of cylindrical guide rollers 18 and 20 are mounted for rotation on support shafts 30 and 32 about axes A and B and are spaced apart along and adjacent the longitudinal side margins 26 and 28 of the support member 34. The support shafts 30 and 32 are themselves supported on frame 36 as shown. The axes A and D define an angle which is substantially equal to the outside angular orientation between adjacent drywall sheets M and N as shown in FIG. 3. Although drywall corners are typically orthogonal or 90°, the invention is easily adapted to any broad range of outside angles such as 60°, 120° and the like as called for by architectural design choice.

As seen in FIG. 3, the bullnose cornerbead D is attached by its longitudinal mounting flanges K and L to the supporting drywall sheets M and N as by nailing therethrough. Thus, the exposed rounded cylindrical outer surface of the bullnose cornerbead D will ultimately have to be finish sanded before painting. A layer of cementious-type drywall filler compound is first applied along F and G so as to fair or feather in the longitudinal edges H and J of exposed central portion of the bullnose cornerbead D. When the cementious material is applied, typically the radiused or contoured rounded portions of the bullnose cornerbead D are also inadvertently covered with this cementious filler material. When cured, it must be removed and smoothly finished to receive paint or other coating materials thereafter. Note that the invention 10 is intended to substantially avoid abrasive contact with these faired filler portions F and G as that is left to other drywall sanding implements of a more suitable, generally flat nature.

The present invention 10 includes several distinctive features which have afforded enhanced operability of the device 10 for its intended purpose. The side margins of the facing surface 17 terminate at 26 and 28 to define alignment recesses or edges for accurate placement and adhesive attachment of the abrasive member 22. Moreover, each of the sets of guide rollers 18 and 20 are relatively large having a diameter of 1⅛". The adhesive pad or member 22 is preferably formed of 2# density open-cell polyester foam material of a highly compressible nature. However, the abrasive member may also be formed of open non-woven fibrous adhesive material such as that known as SCOTCH-BRITE by 3M Corporation. Each replaceable abrasive member 22 includes an adhered abrasive layer 25 which typically has a fabric-reinforced sanding surface of 80 to 120 grit, preferably 80 aluminum oxide grit with PSA backing. The opposite surface 24 is adhesively coated as with double-sided adhesive tape and covered with a protective backing prior to use (not shown).

As best seen in FIG. 3, the device 10 in use is firmly pressed in the direction of arrow S against the bullnose cornerbead D and then moved longitudinally thereof along the length of the bullnose joint D to abrasively remove the cured excess filler material (not shown) and to finish sand the exposed outside radiused portions of each bullnose cornerbead D. Again, the guide rollers 18 and 20, in cooperation with the concaved contour of the abrasive member 22 when the device 10 is in use, substantially match or mate with the transverse cross section of the bullnose cornerbead D and adjacent drywall panels as best described in FIG. 3. The central portion of the abrasive member 22 thereby substantially compresses from a uniform thickness of each abrasive member 22 of approximately ½ inch down to approximately 0.2" or down to about 60% of its initial thickness while the side margins 22*a* and 22*b*, compress down to approximately 0.28" or about 56% of their relaxed thickness of ½". Moreover, by placing each set of guide roller sin Proximity to opposite ends of the support member 34, longitudinal misalignment with the bullnose cornerbead D is eliminated.

To greatly increase the amount of compression required of each abrasive member 22 in order to make surface contact of the guide rollers 18 and 20 against the filler material F and G has shown to be extremely effective in allowing the abrasive layer or surface 25 to accomplish its intended task more easily and uniformly across the entire width and length of the outer surface of the bullnose corner D. The overall width of each abrasive member 22 is slightly increased so that the side margins 26 and 28 of the abrasive layer 25 extend very slightly beyond the side margins of the bullnose corner D. This slight overhang has shown to more effectively blend the filler material F and G to the side margins H and J of the bullnose corner D.

Figure 4:
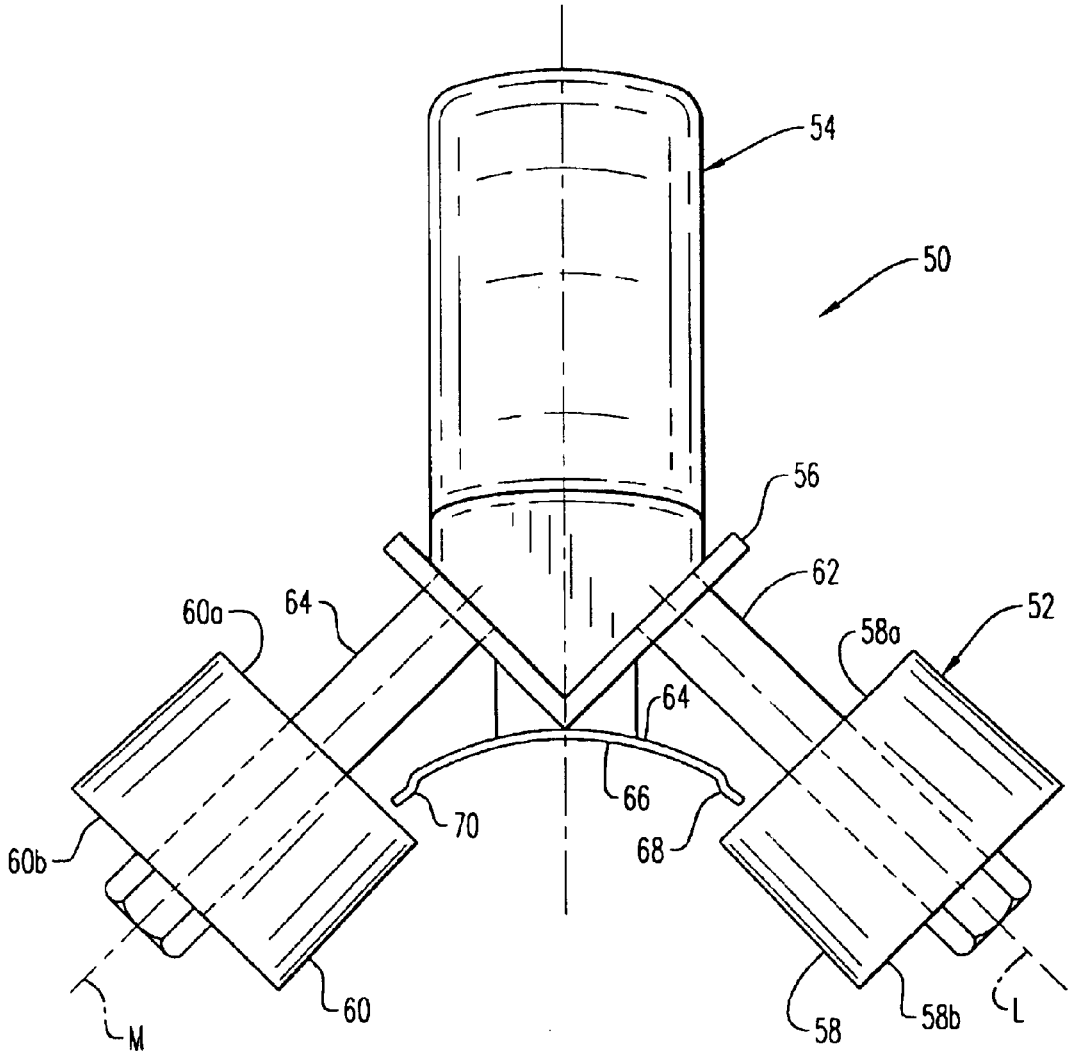
FIG. 4 is a view similar to FIG. 1 showing an alternate embodiment of the invention.

Referring now to FIG. 4, because the filler material shown at F and G in FIG. 3 is fared or feathered in, the precise angle of the cornerbead D and the fared-in filler material F and G may not be exactly 90° but somewhat just a few degrees less than that. In such situations, the embodiment 50 easily deals with this contingency by providing guide rollers pairs 58 and 60 which are tapered rather than cylindrical, tapering from the larger distal ends 58*b* and 60*b* to the smaller proximal ends 58*a* and 60*a*, respectively. Each of these rollers 58 and 60 freely rotate about axes L and M, respectively on support shafts 62 and 64. These support shafts 62 and 64 are rigidly attached to the elongated channel frame 56 of the elongated body 52 in a precise orthogonal orientation therebetween.

As in the previous embodiment 10, this embodiment 50 also includes the elongated body 56 to which is attached a gripable handle 54. The arcuate member 64 having the cylindrical surface 66 and guide edges 68 and 70 are provided and are substantially similar to those previously described in FIGS. 1 to 3.

As may now be more clearly understood, the tapered rollers 58 and 60 accommodate the slight alteration of the generally precise orthogonal nature of the cornerbead installation when the filler material F and G is added and then sand-feathered out to become relatively invisible when painted or otherwise covered decoratively.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A bullnose cornerbead sanding and cleaning device for removing cured drywall filler compound from, and finish sanding of, a bullnose cornerbead which forms a lengthwise extending raised rounded corner joint between adjacent drywall sheets of a drywall installation comprising:

an elongated body having a cylindrical concave-shaped central longitudinal surface positioned between two sets of spaced guide rollers disposed along both longitudinal margins of said longitudinal body each said set of rollers disposed in proximity to an end of said elongated body;

a handle extending away from said elongated body;

a highly compressible elongated abrasive member releasably attachable on one surface thereof, and contourable to and generally coextensive with said longitudinal surface and having an exposed abrasive surface on another surface thereof for mateable sanding and cleaning engagement against substantially only the bullnose cornerbead and drywall filler compound thereon;

said guide rollers, in cooperation with said abrasive member, substantially mating against adjacent drywall panels and the bullnose cornerbead, respectively, whereby substantially only the bullnose cornerbead and drywall filler compound thereon comes into sanding contact with said abrasive layer;

said abrasive member being compressed a substantial amount of a thickness thereof to establish contact between both of said longitudinal margins and the respective adjacent drywall panels whereby a substantial biasing pressure is established between said abrasive surface and the bullnose cornerbead;

each longitudinal margin of said central longitudinal surface is defined by an alignment recess, said alignment recesses spaced apart a distance across said central longitudinal portion substantially equal to a width of said abrasive member to establish lateral placement of said abrasive member with respect to said guide rollers.

2. A bullnose cornerbead sanding and cleaning device for removing cured drywall filler compound from, and finish sanding of, a bullnose cornerbead which forms a lengthwise extending raised rounded corner joint between adjacent drywall sheets of a drywall installation comprising:

an elongated body having a concave-shaped central longitudinal surface positioned between two sets of two spaced guide rollers disposed along longitudinal margins of said longitudinal surface;

a handle means extending away from said elongated body;

a highly compressible abrasive member releasably attachable on one surface thereof to said central longitudinal surface and having an exposed abrasive surface on another surface thereof for mateable sanding and cleaning engagement against substantially only the bullnose cornerbead and drywall filler compound thereon;

said guide rollers being substantially mateable against and freely rollable adjacent drywall panels on either side of the bullnose cornerbead whereby said central longitudinal surface is positioned a certain distance X from the bullnose cornerbead and is stabilized from substantial longitudinal misalignment with respect to the bullnose cornerbead;

said abrasive member having a thickness generally equal to about 2X and, when releasably attached to said central longitudinal surface, is compressed a substantial amount of the thickness 2X down to about X to establish simultaneous contact between both of said sets of guide rollers against the respective adjacent drywall panels whereby a substantial biasing pressure is thereby automatically established between said abrasive surface and the bullnose cornerbead.

3. A bullnose cornerbead sanding and cleaning device for removing cured drywall filler compound from, and finish sanding of, a bullnose cornerbead which forms a lengthwise extending raised rounded corner joint between adjacent drywall sheets of a drywall installation comprising:

an elongated gripable body having a substantially coextensive concave cylindrically shaped central longitudinal surface evenly positioned between two sets of two spaced apart guide rollers disposed along both longitudinal margins of said longitudinal surface;

a highly compressible flat elongated abrasive member releasably attachable on a first surface thereof to said central longitudinal surface, said abrasive member having an exposed abrasive surface on a second surface thereof for sanding and cleaning engagement with the bullnose cornerbead and excess drywall filler compound thereon;

said first surface assuming the cylindrical shape of and generally coextensive with said longitudinal surface when releasably attached thereto whereupon said second surface is non-compliant in shape to that of the bullnose cornerbead;

said guide rollers, when held in simultaneous mating alignment against drywall panels on either side of the bullnose cornerbead, causing said abrasive member to be held substantially parallel to the bullnose cornerbead and automatically compressed a predetermined substantial amount of about half of a thickness of said abrasive member whereby a substantial biasing pressure is established between said abrasive surface and the bullnose cornerbead.

4. A bullnose cornerbead sanding and cleaning device for removing cured drywall filler compound from, and finish sanding a bullnose cornerbead which forms a lengthwise extending raised rounded corner joint between adjacent drywall sheets of a drywall installation comprising:

an elongated body having a cylindrically concave-shaped central longitudinal surface positioned between two sets of two spaced guide rollers disposed along longitudinal margins of said longitudinal surface;

a handle or connection means therefor extending away from said elongated body;

a compressible elongated abrasive layer releasably attachable to and contoured to and substantially coextensive with said longitudinal surface for matable sanding and cleaning engagement against substantially only the bullnose cornerbead and drywall filler compound thereon;

said guide rollers, in cooperation with said abrasive layer, substantially mating against adjacent drywall panels and the bullnose cornerbead, respectively, whereby said longitudinal surface is held substantially parallel to the bullnose cornerbead and substantially only the bullnose cornerbead and drywall filler compound thereon comes into sanding contact with said abrasive layer.

5. A bullnose cornerbead sanding and cleaning device as set forth in claim 1, wherein:

said guide rollers are tapered to accommodate bullnose wall corner joints which are non-orthogonal.

6. A bullnose cornerbead sanding and cleaning device as set forth in claim 2, wherein:

said guide rollers are tapered to accommodate bullnose wall corner joints which are non-orthogonal.

7. A bullnose cornerbead sanding and cleaning device as set forth in claim 3, wherein:

said guide rollers are tapered to accommodate bullnose wall corner joints which are non-orthogonal.

8. A bullnose cornerbead sanding and cleaning device for removing cured drywall filler compound from, and finish sanding a bullnose cornerbead which forms a lengthwise extending raised rounded corner joint between adjacent drywall sheets of a drywall installation comprising:

an elongated body having a cylindrically concave-shaped central longitudinal surface positioned between two sets of two spaced guide rollers disposed along longitudinal margins of said longitudinal surface;

a handle or connection means therefor extending away from said elongated body;

a compressible elongated abrasive layer releasably attachable to and contoured to and substantially coextensive with said longitudinal surface for matable sanding and cleaning engagement against substantially only the bullnose cornerbead and drywall filler compound thereon;

said guide rollers, in cooperation with said abrasive layer, substantially mating against adjacent drywall panels and the bullnose cornerbead, respectively, whereby said longitudinal surface is held substantially parallel to the bullnose cornerbead and substantially only the bullnose cornerbead and drywall filler compound thereon comes into sanding contact with said abrasive layer;

said guide rollers are tapered to accommodate bullnose wall corner joints which are non-orthogonal.

* * * * *